US009770138B2

(12) United States Patent
Engell

(10) Patent No.: US 9,770,138 B2
(45) Date of Patent: Sep. 26, 2017

(54) SHOWER CADDIES WITH ADJUSTABLE BASKETS

(71) Applicant: Maytex Mills, Inc., New York, NY (US)

(72) Inventor: David Harry Engell, Stamford, CT (US)

(73) Assignee: MAYTEX MILLS, INC., New York, NY (US)

( * ) Notice: Subject to any disclaimer, the term of this patent is extended or adjusted under 35 U.S.C. 154(b) by 0 days.

(21) Appl. No.: 15/417,478

(22) Filed: Jan. 27, 2017

(65) Prior Publication Data

US 2017/0215653 A1 Aug. 3, 2017

Related U.S. Application Data

(60) Provisional application No. 62/288,711, filed on Jan. 29, 2016, provisional application No. 62/371,985, filed on Aug. 8, 2016.

(51) Int. Cl.

| | |
|---|---|
| ***A47G 29/087*** | (2006.01) |
| ***A47K 3/28*** | (2006.01) |
| ***A47B 55/02*** | (2006.01) |
| ***A47B 57/26*** | (2006.01) |
| ***A47K 5/04*** | (2006.01) |
| *D06F 57/12* | (2006.01) |

(52) U.S. Cl.

CPC ..... *A47K 3/281* (2013.01); *A47B 55/02* (2013.01); *A47B 57/26* (2013.01); *A47K 5/04* (2013.01); *D06F 57/12* (2013.01)

(58) Field of Classification Search

CPC ..... A47B 55/02; A47B 57/26; A47K 3/281; D06F 57/12

USPC .... 211/119.009, 119.011, 119.004, 119, 117, 211/85.31, 106, 113, 103, 187, 190, 207, 211/107, 181.1; D6/525, 566

See application file for complete search history.

(56) References Cited

U.S. PATENT DOCUMENTS

| | | | | |
|---|---|---|---|---|
| 626,739 | A * | 6/1899 | Vanderman | A47K 1/09 211/119.009 |
| 1,554,137 | A * | 9/1925 | Slifkin | A47B 57/52 108/6 |

(Continued)

FOREIGN PATENT DOCUMENTS

| | | |
|---|---|---|
| GB | 927624 | 5/1963 |

OTHER PUBLICATIONS

International Search Report of the International Searching Authority for PCT/US2017/015244, dated May 31, 2017, 5 pages.

(Continued)

*Primary Examiner* — Joshua J Michener
*Assistant Examiner* — Devin Barnett
(74) *Attorney, Agent, or Firm* — Alan G. Towner, Esq.; Christopher J. Owens, Esq.; Leech Tishman Fuscaldo & Lampl

(57) ABSTRACT

Shower caddies with vertically and horizontally movable baskets are disclosed. Each basket is independently adjustable by a mechanism including a front plate, a rear plate and a draw fastener, which allows the user to adjust both the vertical and horizontal position of the basket from a single control point for simple and easy operation. The shower caddies may also include a tilt-resisting locking mechanism that resists rotation of the caddies when supporting an uneven load.

20 Claims, 8 Drawing Sheets

(56) References Cited

U.S. PATENT DOCUMENTS 1,987,723 A * 1/1935 Thomasma ..... A47K 17/003 211/119.009
2,222,091 A * 11/1940 Schray ..... A47F 5/13 108/28
D190,608 S * 6/1961 Forrester ..... 211/119
3,111,723 A * 11/1963 Bates ..... E04B 2/821 160/135
3,181,702 A * 5/1965 Raphaei ..... A47K 3/281 211/119
3,642,241 A * 2/1972 Kaufman ..... A61M 5/1415 211/117
3,789,996 A * 2/1974 Stroh ..... A47K 3/281 211/106
4,467,925 A * 8/1984 Ratzloff ..... A47F 5/0838 211/103
5,083,729 A * 1/1992 Saeks ..... B62H 3/12 211/17
5,255,401 A * 10/1993 Sambrookes ..... A47K 3/281 206/77.1
5,855,184 A 1/1999 Eichler et al.
6,089,387 A * 7/2000 Varfolomeeva ..... A47B 57/06 211/106
6,412,647 B1 * 7/2002 Ko ..... A47B 55/02 211/106
6,494,327 B2 * 12/2002 Huang ..... A47F 5/0892 211/107
6,520,351 B1 * 2/2003 Zadro ..... A47K 3/281 211/106
D473,411 S * 4/2003 Walker ..... D6/525
6,581,790 B1 * 6/2003 Zadro ..... A47K 3/281 211/119
D479,073 S * 9/2003 Snell ..... A47K 3/281 D6/525
D479,074 S * 9/2003 Snell ..... A47K 3/281 D6/525
D493,991 S * 8/2004 Dretzka ..... A47K 3/281 D6/525
D494,794 S * 8/2004 Winkleman ..... A47K 3/281 D6/525
D496,549 S * 9/2004 Snell ..... A47K 3/281 D6/525
D498,102 S * 11/2004 Snell ..... A47K 3/281 D6/525
D530,551 S * 10/2006 Snell ..... D6/525
D552,391 S * 10/2007 Rosen ..... A47K 3/281 D6/525
D562,608 S * 2/2008 Kramer ..... D6/525
D564,271 S * 3/2008 Snider ..... A47K 3/281 D6/525
D568,657 S * 5/2008 Snider ..... A47K 3/281 D6/525
D568,658 S * 5/2008 Yang ..... A47K 3/281 D6/525
D572,061 S * 7/2008 Snider ..... A47K 3/281 D6/525
D572,062 S * 7/2008 Snider ..... A47K 3/281 D6/525
D572,502 S * 7/2008 Yang ..... D6/525
D573,822 S * 7/2008 Yang ..... D6/523
7,527,157 B2 * 5/2009 Shinn ..... B25H 3/006 211/119
7,611,034 B1 * 11/2009 Peterson ..... A47G 25/60 211/115
7,770,742 B1 * 8/2010 Wagner ..... A47K 3/281 211/113
D622,990 S * 9/2010 Yang ..... D6/525
7,798,339 B2 * 9/2010 Brooks ..... G11B 33/02 211/103
D628,000 S * 11/2010 Lindo ..... A47K 3/281 D6/525
D628,841 S * 12/2010 Yang ..... D6/525
D640,488 S * 6/2011 Didehvar ..... D6/525
7,959,020 B2 * 6/2011 Rosen ..... D06F 79/02 211/106
D651,837 S * 1/2012 Yang ..... D6/525
8,186,521 B2 * 5/2012 Yu ..... A47B 55/02 211/106
8,225,946 B2 * 7/2012 Yang ..... A47B 57/26 108/108
D676,696 S * 2/2013 Primeau ..... D6/525
8,820,543 B2 * 9/2014 Huang ..... B62H 3/12 211/107
D714,571 S * 10/2014 Walker ..... D6/525
D718,554 S * 12/2014 Snider ..... D6/525
D723,834 S * 3/2015 Tawil ..... D6/525
D728,260 S * 5/2015 Snider ..... D6/525
D769,017 S * 10/2016 Tsai ..... D6/525
D769,641 S * 10/2016 Yang ..... D6/525
D770,197 S * 11/2016 Yang ..... D6/525
9,693,660 B1 * 7/2017 Stelmarski et al. ... A47K 3/281
2003/0000905 A1 * 1/2003 Zidek ..... A47F 5/06 211/205
2004/0188369 A1 * 9/2004 Yu ..... A47K 5/04 211/106
2004/0200936 A1 * 10/2004 Opperthauser ..... F16L 59/135 248/62
2006/0261022 A1 * 11/2006 Sampaio ..... A47K 3/281 211/119.009
2008/0000859 A1 * 1/2008 Yang et al. ..... A47B 57/26 211/90.02
2008/0047913 A1 * 2/2008 Naden ..... A47K 3/281 211/119.009
2008/0053935 A1 * 3/2008 Newbouild ..... A47B 57/08 211/90.02
2008/0164384 A1 * 7/2008 Rosen ..... D06F 79/02 248/117.1
2008/0224011 A1 * 9/2008 Chang ..... A47K 3/281 248/317
2008/0230494 A1 * 9/2008 Galt ..... A47K 13/06 211/13.1
2009/0188880 A1 * 7/2009 Yang ..... A47K 3/281 211/113
2010/0102014 A1 * 4/2010 Yang ..... A47K 3/281 211/113
2010/0133218 A1 * 6/2010 Yang ..... A47K 3/281 211/119.009
2011/0271438 A1 11/2011 Yang et al.
2012/0091088 A1 * 4/2012 Didehvar ..... A47B 45/00 211/113
2012/0159748 A1 * 6/2012 Carney ..... A47K 3/281 24/457
2012/0217215 A1 * 8/2012 Emery ..... A47K 3/281 211/119.009
2013/0313212 A1 * 11/2013 Lindo ..... A47K 3/281 211/119.011
2014/0124467 A1 * 5/2014 Kwok ..... A47K 3/281 211/113
2014/0124598 A1 5/2014 Vaccaro et al.
2014/0224754 A1 * 8/2014 Baines ..... A47K 3/281 211/119.009
2014/0319083 A1 * 10/2014 Stark ..... A47K 3/281 211/26
2015/0157124 A1 * 6/2015 Cipolla ..... A47F 5/02 211/86.01
2015/0342419 A1 * 12/2015 Yatscoff ..... F16B 45/04 211/119.011
2016/0066751 A1 * 3/2016 Hinson ..... A47K 3/281 211/85.12
2016/0374467 A1 * 12/2016 Gasparino ..... A47B 45/00 211/119.011

OTHER PUBLICATIONS

International Search Report and Written Opinion of the US International Searching Authority for PCT/US2017/015244, fated May 31, 2017 (15 pp).
Title: "InterDesign Linea Adjustable Bathroom Shower Caddy for Shampoo, Conditioner, Soap—Bronze" Url: https://www.amazon.

(56) References Cited

OTHER PUBLICATIONS com/InterDesign-Adjustable-Bathroom-Shampoo-Conditioner/dp/B00DUVTDQS Accessed: Jun. 5, 2017 (7 pp).

* cited by examiner

SHOWER CADDIES WITH ADJUSTABLE BASKETS

CROSS-REFERENCE TO RELATED APPLICATIONS

This application claims the benefit of U.S. Provisional Patent Application Ser. No. 62/288,711 filed Jan. 29, 2016 and U.S. Provisional Patent Application Ser. No. 62/371,985 filed Aug. 8, 2016, which are incorporated herein by reference.

FIELD OF THE INVENTION

The present invention relates to shower caddies, and more particularly relates to shower caddies having adjustable baskets.

BACKGROUND INFORMATION

Conventional shower caddies include baskets arranged vertically on a support member extending downward from an upper hook that engages a shower pipe. The baskets are typically rigidly mounted on the support member. This arrangement often precludes the storage of larger containers of shower and bath products.

An additional disadvantage of conventional shower caddies is that they tilt due to the weight of items that are placed on or removed from the caddies. Some shower caddies use rubber grips or suction cups at their bottoms to help control the tilting, but if the objects placed in the baskets are sufficiently heavy they may still tilt.

SUMMARY OF THE INVENTION

The present invention provides shower caddies with vertically and horizontally movable baskets. Each basket is independently adjustable by a mechanism including a front plate, a rear plate and a draw fastener, which allows the user to adjust both the vertical and horizontal position of the basket from a single control point for simple and easy operation. The shower caddies may also include a tilt-resisting locking mechanism that resists rotation of the caddies when supporting an uneven load.

An aspect of the present invention is to provide a shower caddy assembly comprising a vertical support structure comprising first and second vertical support rods, at least one basket comprising at least one horizontal basket support rod, and an adjustment mechanism comprising a front plate, a rear plate, and a draw fastener. The front and rear plates are slidably adjustable vertically along the first and second vertical support rods, and the at least one horizontal basket support rod is slidable horizontally in relation to the front and rear plates.

Another aspect of the present invention is to provide a tilt-resisting shower caddy assembly comprising a vertical support structure, at least one basket coupled to the vertical support structure, and a tilt-resisting support hook coupled to the vertical support structure comprising a generally U-shaped upper pipe engaging portion comprising downwardly extending side legs. At least one of the side legs comprises a threaded fastener extending from an exterior side surface to an interior side surface thereof structured and arranged to press against a shower pipe to thereby resist tilting of the shower caddy assembly when installed on the shower pipe.

These and other aspects of the present invention will be more apparent from the following description.

DETAILED DESCRIPTION

Figure 1:
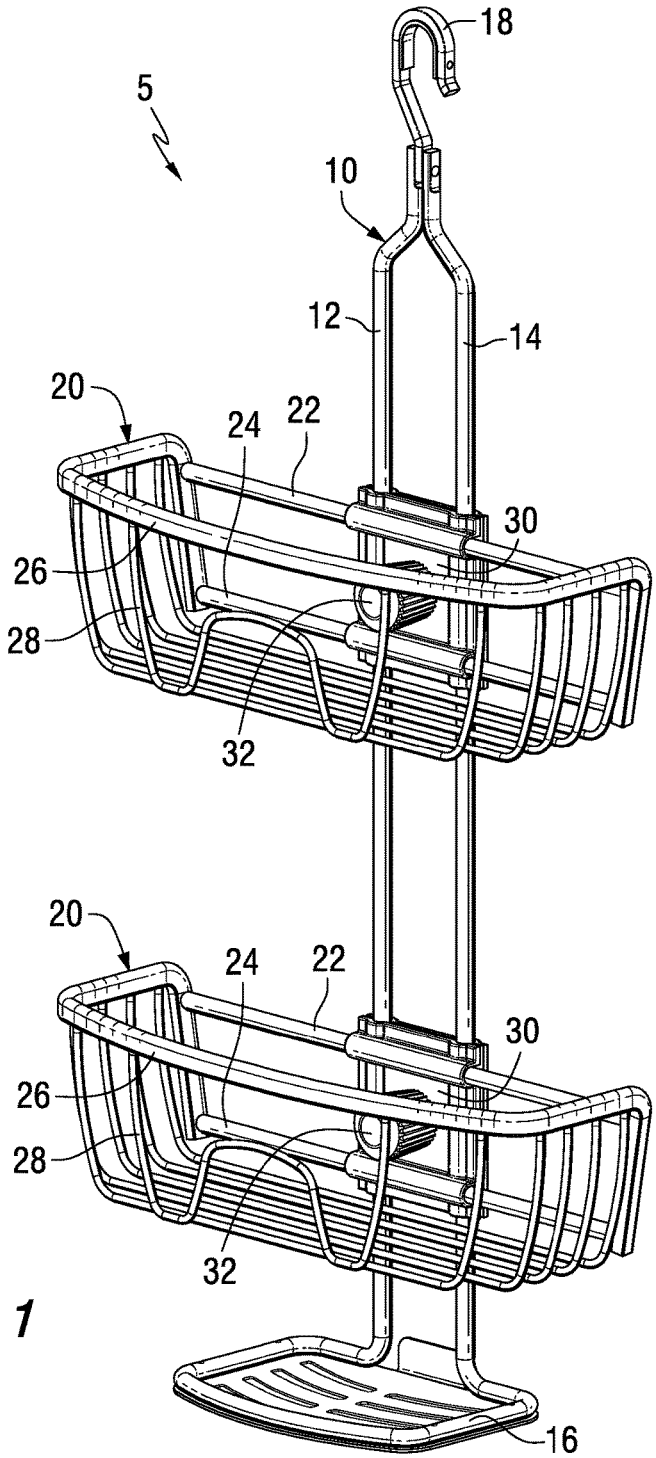
FIG. 1 is an isometric view of a shower caddy assembly including adjustment mechanisms in accordance with an embodiment of the present invention.
Figure 4:
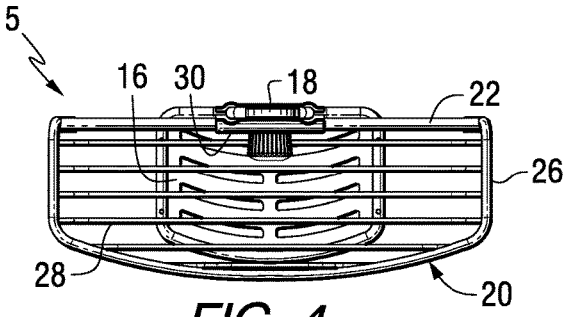
FIG. 4 is a top view of the shower caddy of FIG. 1.
Figure 2:
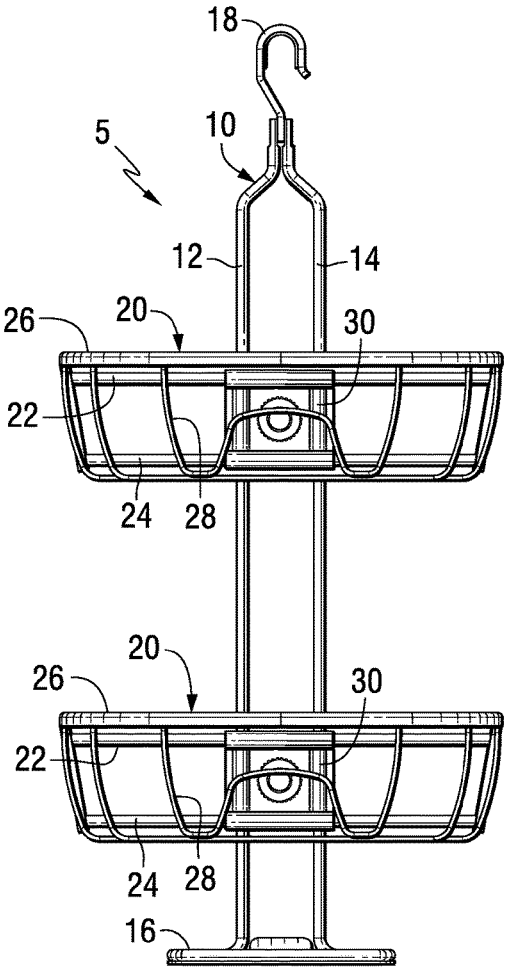
FIG. 2 is a front view of the shower caddy of FIG. 1.

FIG. 1 illustrates a shower caddy assembly 5 in accordance with an embodiment of the present invention. The shower caddy assembly 5 includes a vertical support structure 10 comprising a first vertical support rod 12, a second vertical support rod 14 parallel with the first vertical support rod 12, and a bottom shelf 16. The vertical support structure 10 may be mounted on a shower pipe connected to a shower head (not shown) by a tilt-resisting support hook 18, which is described in more detail below. In the embodiment shown, the shower caddy assembly 5 includes two baskets 20 mounted on the vertical support structure 10 by an adjustment mechanism 30. The baskets 20 are configured to hold a variety of bathing accessories. While two baskets 20 of similar size are shown in this embodiment, any other suitable number of baskets 20 may be used. For example, one, three, four or more baskets may be mounted on the vertical support structure 10. In addition, the baskets may vary in size, for example, the top basket may be smaller than the bottom basket.

As shown in FIGS. 1-4, each basket 20 includes an upper horizontal basket support rod 22, a lower horizontal basket support rod 24, a retaining rod 26 and retaining wire 28. In the embodiment shown, each basket 20 comprises two horizontal basket support rods, however, it is to be understood that any other suitable number of horizontal basket support rods may be used, e.g., one, two, three or more horizontal basket support rods. For example, a basket 20 with a single horizontal support rod at the upper edge of the basket 20 may be used. The upper and lower horizontal basket support rods 22 and 24 are located at the rear of each basket 20, are parallel with each other, and are vertically offset from each other. In the embodiment shown, the retaining rod 26 is connected to the upper and lower horizontal basket support rods 22 and 24 and forms the upper front and side portions of the basket 20. The retaining wire 28 is connected to the retaining rod 26 and forms the bottom of the basket 20. In accordance with another embodiment, the upper and/or lower horizontal basket support rods 22 and 24 may be extended along the side and front portions of the basket 20 thereby providing an integral structure in place of the retaining rod 26. In the embodiment shown, the retaining wire 28 is connected to the upper and lower horizontal basket support rods 22 and 24 to form the bottom of the basket 20 and to provide a rigid basket. While particular basket arrangements are described herein, it is to be understood that any other suitable basket structures may be used in accordance with the present invention.

In the embodiment shown, the bottom shelf 16 is formed by an extension of the first and second vertical support rods 12 and 14 which form the perimeter of the bottom shelf 16. In another embodiment, the bottom shelf 16 may be mounted on the vertical support structure 10 by an adjustment mechanism similar to the mechanism 30 used with the baskets 20. The bottom shelf 16 may be configured as a soap dish having a bottom formed by an insert placed into a central opening formed by the first and second vertical support rods. However, any other suitable arrangement of the bottom shelf 16 may be used. For example, the bottom shelf 16 may comprise a wire bottom, hooks or the like, or the bottom shelf may be eliminated.

Figure 5:
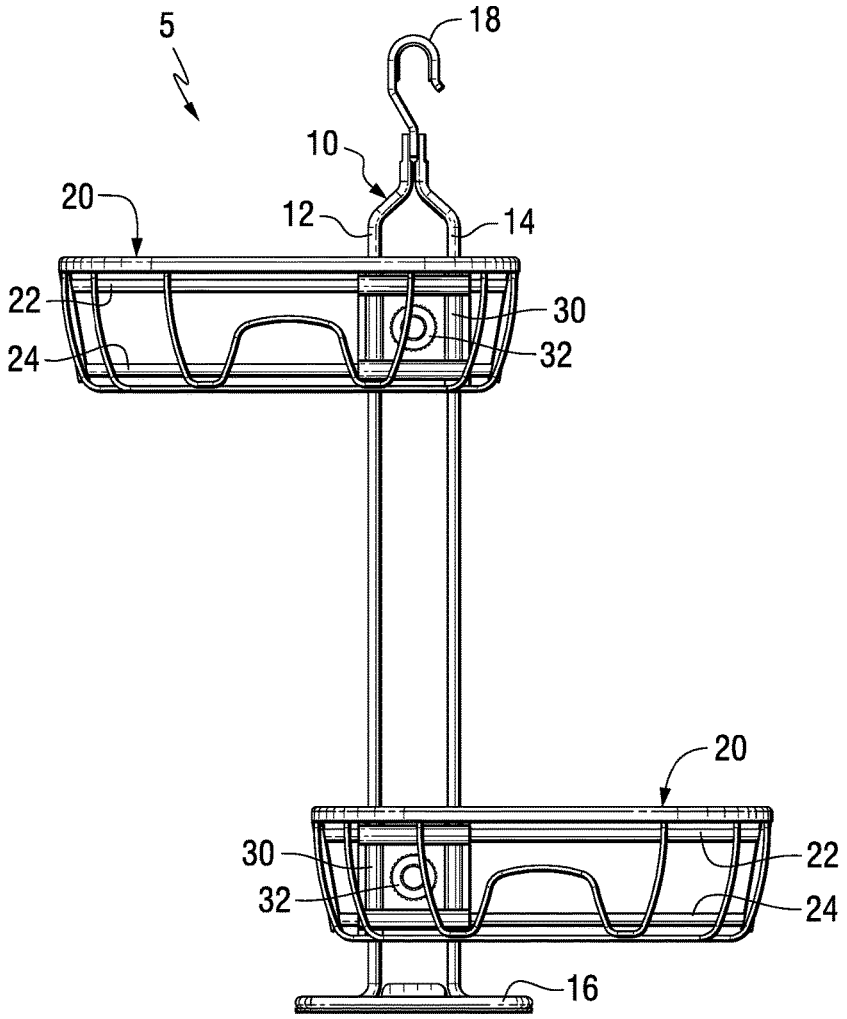
FIG. 5 is a front view of the shower caddy of FIG. 1, showing the baskets adjusted to different horizontal and vertical positions using the adjustment mechanisms in accordance with an embodiment of the present invention.

In accordance with embodiments of the present invention, the adjustment mechanism 30 includes a draw fastener 32 for selectively positioning the basket(s) 20 at desired locations. As shown by comparing FIGS. 2 and 5, each adjustment mechanism 30 of the shower caddy assembly 5 allows its respective basket 20 to be adjustably positioned at different horizontal positions, and at different vertical positions, in relation to the vertical support structure 10. When the shower caddy assembly 5 is mounted on a shower pipe (not shown), the first and second vertical support rods 12 and 14 of the vertical support structure remain stationary, while the adjustment mechanism 30 allows the baskets 20 to move both vertically up and down, and horizontally left and right. The ability of the baskets 20 to move both vertically and horizontally allows the shower caddy assembly 5 to easily accommodate containers and other bath items and accessories of varying sizes. As more fully described below, the provision of an adjustment mechanism 30 with a single draw fastener 32 allows for easy manipulation both horizontally and vertically of each basket 20 with a simple loosening and tightening of the draw fastener 32. The simple manipulation of the draw fastener 32 for each basket 20 can be performed at a single central location.

Figure 6:
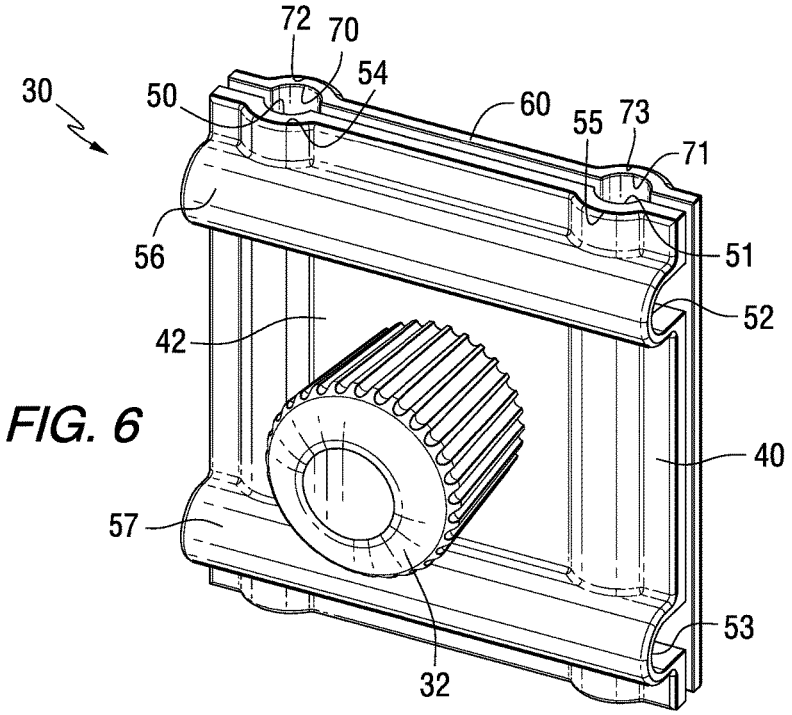
FIG. 6 is an isometric view of an adjustment mechanism in accordance with an embodiment of the present invention.
Figure 7:
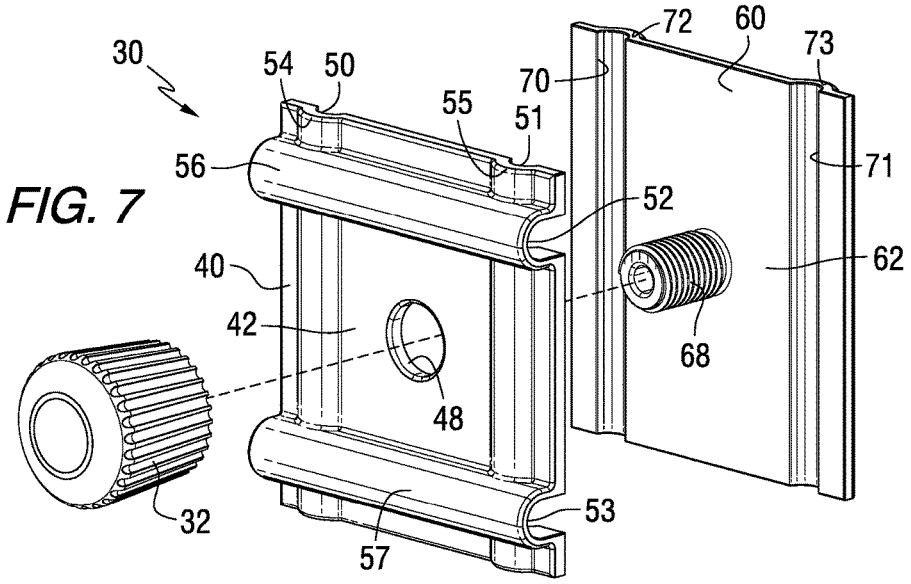
FIG. 7 is an exploded isometric view of the adjustment mechanism of FIG. 6.
Figure 8:
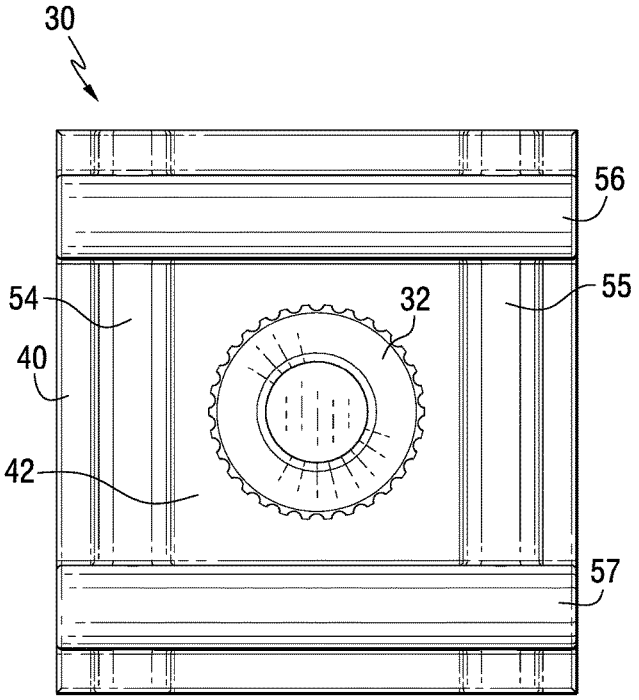
FIG. 8 is a front view of the adjustment mechanism of FIG. 6.

As shown in FIGS. 6-8, the adjustment mechanism 30 comprises a generally planar front plate 40, a generally planar back plate 60, and the draw fastener 32. When the shower caddy assembly 5 is installed, the front and back plates 40 and 60 are aligned in parallel vertical planes that are offset from each other. The front plate 40 is horizontally moveable from the back plate 60 in a direction normal to planes of the plates 40 and 60. The draw fastener 32 may be tightened to draw the front plate 40 toward the back plate 60 to secure the front and back plates against vertical movements with respect to the vertical support rods 12 and 14. The draw fastener 32 also secures each basket 20 against horizontal movement. In the embodiment shown, the draw fastener 32 comprises an internally threaded adjustment knob that may be threadingly engaged with a threaded stud 68 extending from the back plate, however, any other suitable hand manipulatable mechanism may be used. The draw fastener 32 may be rotated to increase the spacing between the plates 40 and 60 in order to allow sliding movement of the vertical support rods 12 and 14 within the adjustment mechanism 30, and to allow sliding movement of the horizontal basket support rods 22 and 24 within the adjustment mechanism 30. The draw fastener 32 of the adjustment mechanism 30 may thus provide a central control point for simple and easy operation.

The adjustment mechanisms 30 may be made of any suitable materials, including plastic, metals, or the like. For example, the front plate 30, back plate 60 and draw fastener 32 may be made of plastics such as polyethylene, polypropylene or polyvinyl chloride that are sufficiently rigid but slightly flexible to allow a desired amount of deflection when the draw fastener 32 is tightened to draw the front and back plates 40 and 60 together.

As shown in FIGS. 6-8 and 11, the front plate 40 includes a planar central region 42, left edge 43, right edge 44, top edge 45, bottom edge 46, and center opening 48. In the embodiment shown, the center opening 48 is located in the center of the planar central region 42 of the front plate. In the embodiment shown, a generally square front plate 40 having four straight edges is shown. However, any other suitable shape of front plate may be used, e.g., rectangular, circular, ovular, triangular, a shape having two straight edges and two curved edges, or the like.

Figure 10:
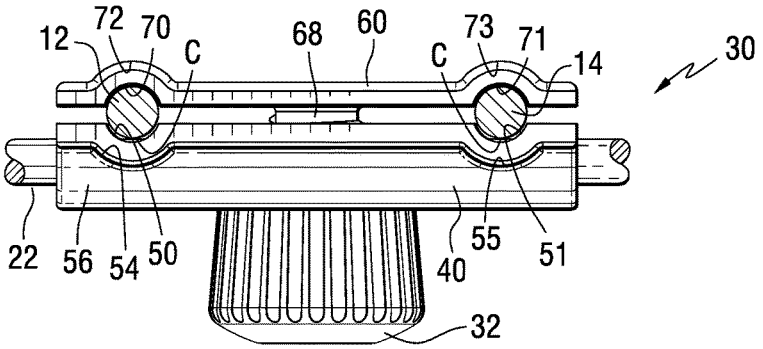
FIG. 10 is a top view of the adjustment mechanism of FIG. 6.
Figure 9:
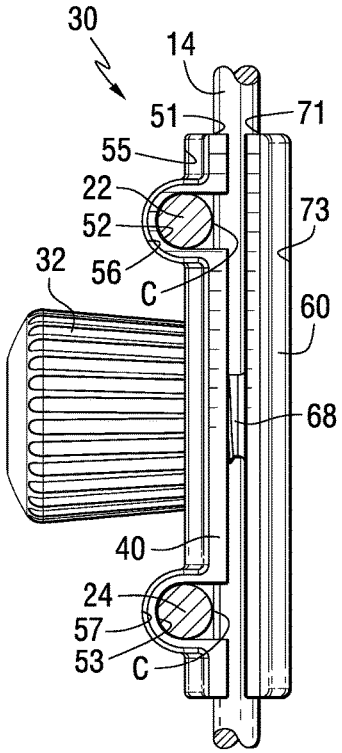
FIG. 9 is a side view of the adjustment mechanism of FIG. 6.
Figure 13:
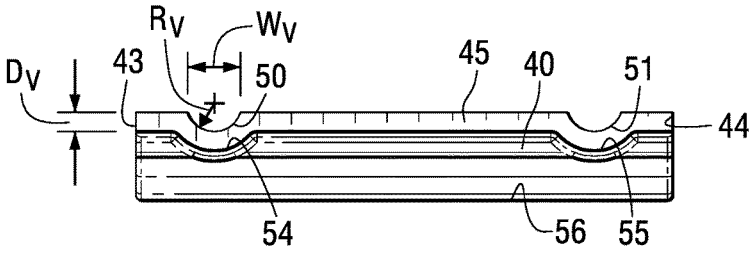
FIG. 13 is a top view of the front plate of FIG. 11.
Figure 11:
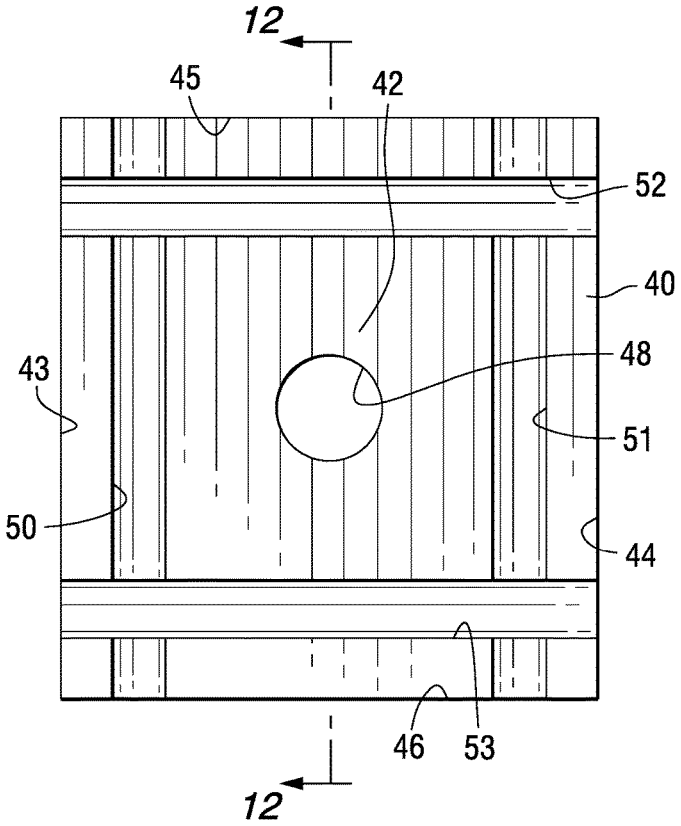
FIG. 11 is a front view of the front plate of the adjustment mechanism in accordance with an embodiment of the present invention.

In accordance with an embodiment of the present invention, the front plate 40 includes first and second vertical support rod receiving guide channels 50 and 51 recessed in a direction perpendicular to the planar surface of the front plate 40, as shown most clearly in FIGS. 11 and 13. Each of the vertical guide channels 50 and 51 has a vertical support rod slidably disposed therein, as shown in FIGS. 9 and 10. The front plate 40 also includes first and second horizontal rod receiving guide channels 52 and 53 recessed in a direction perpendicular to the planar surface of the front plate 40, as shown most clearly in FIGS. 11 and 12. Each of the horizontal guide channels 52 and 53 has a horizontal basket rod slidably disposed therein, as shown in FIGS. 9 and 10. For example, the first horizontal guide channel 52 may slidably receive the upper horizontal basket support rod 22 and the second horizontal guide channel 53 may slidably receive the lower horizontal basket support rod 24. In the embodiment shown, the front plate 40 comprises two horizontal guide channels, but any other suitable number of horizontal guide channels may be used, e.g., zero, one, three or more.

As shown in FIGS. 6-10, 12 and 13, the vertical guide channels 50 and 51 of the front plate 40 form vertical raised regions 54 and 55 on the front surface of the front plate 40. The horizontal guide channels 52 and 53 of the front panel 40 form horizontal raised regions 56 and 57 on the front surface. The vertical raised regions 54 and 55 and horizontal raised regions 56 and 57 thus extend forward from the planar front plate 40. In accordance with an embodiment of the present invention, the planar central region 42 is located in an interior region between the vertical raised regions 54 and 55 and horizontal raised regions 56 and 57.

As shown in FIGS. 3, 7 and 14-17, the back plate 60 includes a planar central region 62, left edge 63, right edge 64, top edge 65, bottom edge 66, and threaded stud 68. The threaded stud 68 may extend from the center of the planar central region 62 of the back plate, and is substantially aligned with the center opening 48 of the front plate 40. In accordance with an embodiment of the present invention, the internally threaded adjustment knob 32 is threadingly engaged with the threaded stud 68. In the embodiment shown, a generally square back plate 60 having four straight edges is shown. However, any other suitable shape of back plate may be used, e.g., rectangular, circular, ovular, triangular, a shape having two straight edges and two curved edges, or the like.

Figure 16:
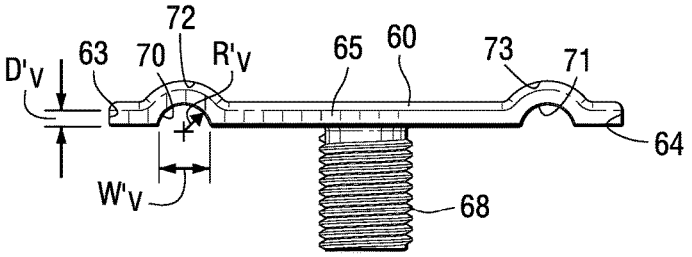
FIG. 16 is a top view of the back plate of FIG. 14.
Figure 14:
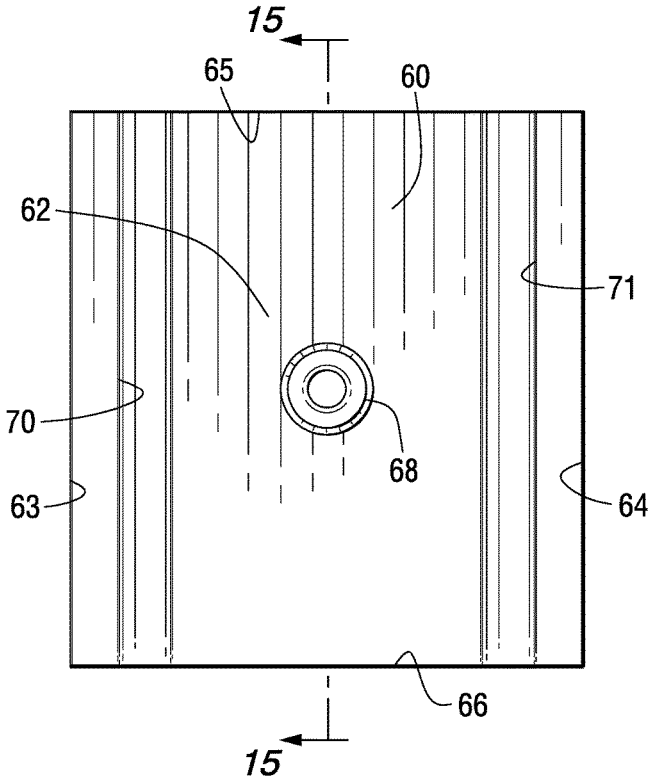
FIG. 14 is a front view of the back plate of the adjustment mechanism in accordance with an embodiment of the present invention.
Figure 15:
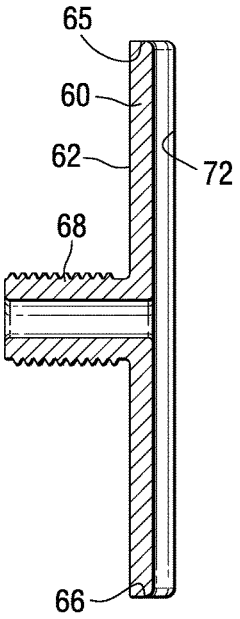
FIG. 15 is a sectional view of the back plate taken through line 16-16 of FIG. 15.
Figure 17:
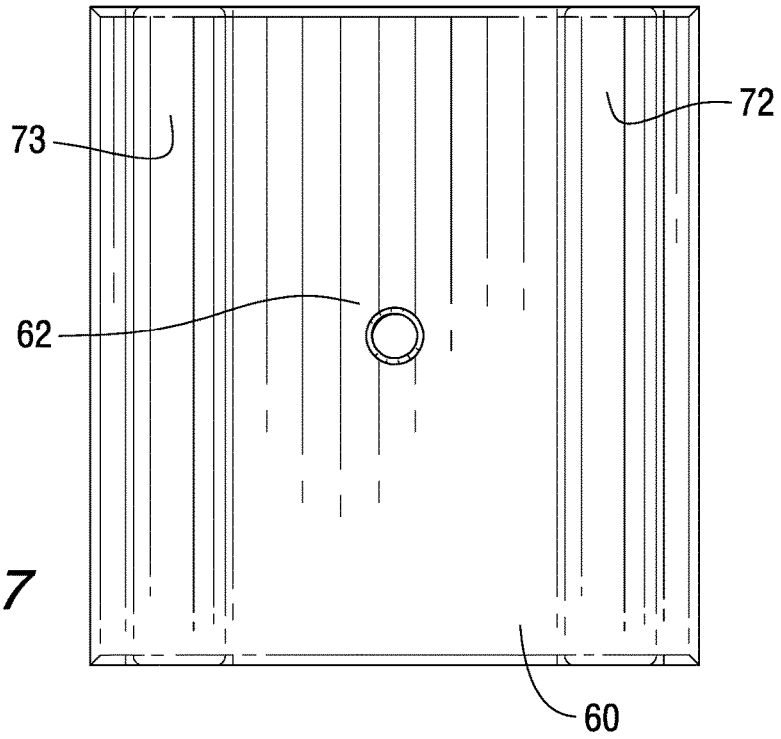
FIG. 17 is a back view of the back plate of FIG. 14.

In accordance with an embodiment of the present invention, the back plate 60 includes first and second vertical support rod receiving guide channels 70 and 71 recessed in a direction perpendicular to the planar surface of the back plate 60, as shown most clearly in FIGS. 14 and 16. Each of the vertical guide channels 70 and 71 has a vertical support rod slidably disposed therein, as shown in FIGS. 9 and 10.

As shown in FIGS. 6-10 and 15-17, the vertical guide channels 70 and 71 form vertical raised regions 72 and 73 on the back surface of the back plate 60. The vertical raised regions 72 and 73 thus extend backward from the planar back plate 60. In accordance with an embodiment of the present invention, the planar central region 62 is located in an interior region between the vertical raised regions 72 and 73.

The vertical support structure 10 and baskets 20 may be made of any suitable materials, including corrosion resistant metals such as aluminum and/or stainless steel, plastic or the like. Any suitable gauge of wire may be used for the rods of the vertical support structure 10 and baskets 20. In accordance with an embodiment of the present invention, the first and second vertical support rods 12 and 14 and the upper and lower horizontal basket support rods 22 and 24 may have a circular cross-section having a diameter. For example, the diameter of the first and second vertical support rods 12 and 14 and the upper and lower horizontal basket support rods 22 and 24 may range from 0.05 to 0.6 inch, or from 0.1 to 0.5 inch or from 0.15 to 0.4 inch. However, any other suitable shape and size of first and second vertical support rods 12 and 14 and upper and lower horizontal basket support rods 22 and 24 may be used, e.g., square, rectangular, ovular, hexagonal or the like. Although the first and second vertical support rods 12 and 14 and the upper and lower horizontal basket support rods 22 and 24 shown in FIGS. 1-5 have similar diameters, it is to be understood that any other suitable sizes may be used, e.g., the first and second vertical support rods 12 and 14 may have different diameters compared with upper and lower horizontal basket support rods 22 and 24, the upper and lower horizontal basket support rods 22 and 24 may have different diameters, etc.

As shown in FIGS. 9 and 10, when the draw fastener 32 is tightened to draw the front plate 40 toward the back plate 60, the horizontal basket support rods 22 and 24 are brought into contact with vertical support rods 12 and 14 forming contact points C. In the embodiment shown, the contact points C may be formed at four separate points of the adjustment mechanism 30, however, any other suitable number contact points C may be formed, e.g., zero, one, two, three or more. The contact points C between the horizontal basket support rods 22 and 24 and the vertical support rods 12 and 14 provide direct engagements between the rods which help secure the adjustment mechanism 30 against vertical movements from their selected vertical position with respect to the vertical support rods 12 and 14 even when the baskets 20 are heavily loaded. The contact points C also help secure each basket 20 against horizontal movement. For example, tightening of the draw fastener 32 causes the vertical guide channels 50 and 51 of the front plate 40 to press against the vertical support rods 12 and 14 and forces them toward the back plate 60. This arrangement also forces the vertical support rods 12 and 14 to press into the vertical guide channels 70 and 71 of the back plate 60. Once the vertical support rods 12 and 14 are pressed into the vertical guide channels 70 and 71 of the back plate 60, additional tightening of the draw fastener 32 may form or increase the pressure at the contact points C between the horizontal basket support rods 22 and 24 and the vertical support rods 12 and 14. In the embodiment shown, the contact points C result in each vertical support rod directly contacting each horizontal basket support rod. This allows the horizontal basket support rods 22 and 24 and vertical support rods 12 and 14 to be engaged at four contact points C.

In accordance with an embodiment of the present invention, the draw fastener 32 exerts a central draw force on the planar central region 42 of the front plate 40 and the planar central region 62 of the back plate 60. The draw force on the front surface of the planar central region 42 of the front plate 40 presses the planar central region 42 toward the planar central region 62 of the back plate. The draw force may also deflect the planar central region 62 and the planar central region 42 toward each other due to the slightly flexible nature of the front and back plates 40 and 60. As shown in FIGS. 8-10, the draw force is applied by the draw fastener 32 in a central region between the four contact points C, which are equally spaced from the centrally applied draw force. This equal spacing results in a substantially equal amount of force being applied to each contact point C. In accordance with an embodiment of the present invention, the resilient nature of the front plate 40 and back plate 60 may help to provide the substantially equal amount of force to each contact point C. Although, the draw fastener 32 of the adjustment mechanism 30 shown in FIGS. 8-10 provides a draw force in a central region between the four contact points C, it is to be understood that the draw force may be provided at any other suitable location, e.g., at a location that is not equally spaced from the contact points C.

Figure 12:
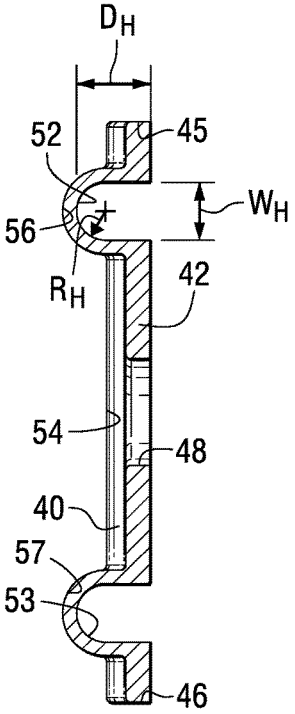
FIG. 12 is a side sectional view of the front plate taken through line 12-12 of FIG. 11.

As shown in FIG. 12, the horizontal guide channels 52 and 53 have a depth $D_H$ and a width $W_H$ selected to allow the horizontal basket support rods 22 and 24 to be totally contained in the horizontal guide channels 52 and 53. For example, the depth $D_H$ of the horizontal guide channels 52 and 53 measured in a direction perpendicular to a planar surface of the front plate 40 may range from 0.1 to 0.8 inch, or from 0.15 to 0.6 inch or from 0.2 to 0.5 inch. In certain embodiments, the depth $D_H$ of the horizontal guide channels 52 and 53 is greater than the diameter of the horizontal basket support rods 22 and 24. For example, the depth $D_H$ of the first and second horizontal guide channels may be from 5 to 100 percent greater, for example, from 10 to 80 percent greater, or from 15 to 50 percent greater than the diameter of the horizontal basket support rods 22 and 24. In certain embodiments, the width $W_H$ of the horizontal guide channels 52 and 53 may typically range from 0.05 to 0.7 inch, for example, from 0.1 to 0.6 inch, or from 0.15 to 0.5 inch. The width $W_H$ may be equal to or slightly greater than the diameter of the horizontal basket support rods 22 and 24.

As shown in FIG. 12, the horizontal guide channels 52 and 53 have a radius $R_H$ that is selected to allow the horizontal basket support rods 22 and 24 to be totally inserted and contained in the horizontal guide channels 52 and 53. For example, the radius $R_H$ of the horizontal guide channels 52 and 53 may range from 0.025 to 0.4 inch, or from 0.05 to 0.3 inch or from 0.1 to 0.25 inch. In accordance with an embodiment of the present invention, the depth $D_H$, width $W_H$ and radius $R_H$ of the horizontal guide channels 52 and 53 may be varied depending on the diameter, size and shape of the horizontal basket support rods 22 and 24. As shown in FIG. 12, the upper and lower horizontal guide channels 52 and 53 may have identical depths $D_H$, widths $W_H$ and/or radiuses $R_H$, or they may be different.

As shown in FIG. 13, the vertical guide channels 50 and 51 of the front plate 40 have a depth $D_V$ and a width $W_V$ selected to allow the vertical support rods 12 and 14 to be partially contained in the vertical guide channels 50 and 51. For example, the depth $D_V$ of the vertical guide channels 50 and 51 measured in a direction perpendicular to a planar surface of the front plate 40 may range from 0.01 to 0.5 inch, or from 0.03 to 0.3 inch or from 0.05 to 0.2 inch. In certain embodiments, the width $W_V$ of the vertical guide channels 50 and 51 may typically range from 0.05 to 0.6 inch, or from 0.1 to 0.5 inch or from 0.15 to 0.4 inch.

As shown in FIG. 13, ends of the vertical guide channels 50 and 51 of the front plate 40 have a radius $R_V$ that is also selected to accommodate and receive the vertical support rods 12 and 14. For example, the radius $R_V$ of the vertical guide channels 50 and 51 may range from 0.025 to 0.4 inch, or from 0.05 to 0.3 inch or from 0.1 to 0.25 inch. In accordance with an embodiment of the present invention, the depth $D_V$, width $W_V$ and radius $R_V$ of the vertical guide channels 50 and 51 may be varied depending on the diameter, size and shape of the vertical support rods 12 and 14. As shown in FIG. 13, the first and second vertical guide channels 50 and 51 of the front plate 40 may have identical depths $D_V$, widths $W_V$ and/or radiuses $R_V$, or they may be different.

As shown in FIG. 16, the vertical guide channels 70 and 71 of the back plate 60 have a depth $D'_V$ and a width $W'_V$ selected to allow the vertical support rods 12 and 14 to be partially contained in the vertical guide channels 70 and 71. For example, the depth $D'_V$ of the vertical guide channels 70 and 71 measured in a direction perpendicular to a planar surface of the back plate 60 may range from 0.01 to 0.5 inch, or from 0.03 to 0.3 inch or from 0.05 to 0.2. In certain embodiments, the width $W'_V$ of the vertical guide channels 70 and 71 may range from 0.05 to 0.6 inch, or from 0.1 to 0.5 inch or from 0.15 to 0.4 inch.

As shown in FIG. 16, the ends of vertical guide channels 70 and 71 have a radius $R'_V$ that is also selected to accommodate and receive the vertical support rods 12 and 14. For example, the radius $R'_V$ of the vertical guide channels 70 and 71 may range from 0.025 to 0.4 inch, or from 0.05 to 0.3 inch or from 0.1 to 0.25 inch. In accordance with an embodiment of the present invention, the depth $D'_V$, width $W'_V$ and radius $R'_V$ of the vertical guide channels 70 and 71 may be varied depending on the size of the vertical support rods 12 and 14. As shown in FIG. 16, the first and second vertical guide channels 70 and 71 of the back plate 60 may have identical depths $D'_V$, widths $W'_V$ and/or radiuses $R'_V$, or they may be different.

In accordance with an embodiment of the present invention, the first and second vertical guide channels 50 and 51 of the front plate 40 and the first and second vertical guide channels 70 and 71 of the back plate 60 form first and second opposing vertical guide channels when the adjustment mechanism 30 is assembled, as shown most clearly in FIGS. 6, 9 and 10. The first and second vertical guide channels 50 and 51 of the front plate 40 and the first and second vertical guide channels 70 and 71 of the back plate 60 may have corresponding depths and/or widths. For example, the depth $D_V$ of the vertical guide channels 50 and 51 of the front plate 40 may be equal to the depth $D'_V$ of the vertical guide channels 70 and 71 of the back plate 60.

In accordance with an embodiment of the present invention, the depths $D_H$ of horizontal guide channels 52 and 53, and the depths $D_V$ of the first and second vertical guide channels 50 and 51, of the front plate 40 are selected to provide the contact points C, as shown in FIGS. 9 and 10. When the adjustment mechanism 30 is tightened, the depth $D_H$ of the horizontal guide channels 52 and 53 and the depths $D_V$ and $D'_V$ of the opposing vertical guide channels 50, 70 and 51, 71, are selected to allow the vertical support rods 12 and 14 and horizontal basket support rods 22 and 24 to contact each other. As shown in FIGS. 9 and 10, when the draw fastener 32 is tightened on the threaded stud 68 to cause the contact points C between the vertical support rods 12 and 14 and the horizontal basket support rods 22 and 24, there may be a gap between the front plate 40 and the back plate 60. Alternatively, the contact points C may still be formed if the front plate 40 and the back plate 60 are brought into contact by the tightening of the adjustment mechanism 30.

In the embodiment shown, the front plate 40 includes two vertical guide channels 50 and 51 and two horizontal guide channels 52 and 53. However, it is it be understood that the front plate 40 may only include horizontal guide channels 52 and 53, in which case, only the back plate 60 may include vertical guide channels 50 and 51. In this alternative embodiment, the depth $D'_V$ of the vertical guide channels 70 and 71 may be altered to accommodate a greater portion of the diameter of the vertical support rods 12 and 14. For example, the depth $D'_V$ and width $W'_V$ of the vertical guide channels 70 and 71 may be similar to the depth $D_H$ and/or width $W_H$ of the horizontal guide channels 52 and 53, as previously described herein. In accordance with another embodiment, the front plate 40 may only include vertical guide channels, and the back plate 60 may only include both horizontal and vertical guide channels.

Figure 18:
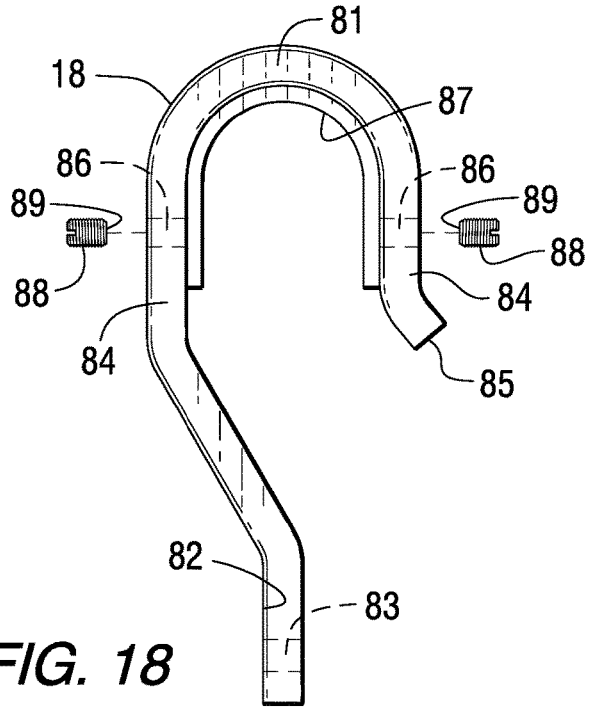
FIG. 18 is a front view of a tilt-resisting support hook in accordance with an embodiment of the present invention.

As shown in detail in FIG. 18, the tilt-resisting support hook 18 comprises an upper pipe engaging portion 81 and a lower portion 82 connected to the vertical support structure 10. In the embodiment shown, the upper pipe engaging portion 81 is generally "U"-shaped and comprises two downwardly extending side legs 84. However, any other suitable shape of upper pipe engaging portion may be used. In the embodiment shown in FIG. 18, one downwardly extending side leg 84 forms an open end 85, while the other downwardly extending side leg 84 is connected to the vertical support structure 10. The open end 85 of the upper pipe engaging portion 81 allows the tilt-resisting support hook 18 to be easily installed on shower pipes having various sizes of shower heads. While the tilt-resisting support hook 18 shown in FIG. 18 has an open end 85, in other embodiments the downwardly extending side legs 84 may form a closed loop at the lower portion 82 and/or to the vertical support structure 10. For example, the downwardly extending side legs 84 of the generally U-shaped upper pipe engaging portion 81 may extend downwardly to couple with the vertical support rods 12 and 14 (not shown). In this embodiment, the downwardly extending side legs 84 may be connected to the vertical support rods 12 and 14 by any suitable attachment means, such as, mechanical fasteners or welding, or may be integrally formed therewith.

Figure 3:
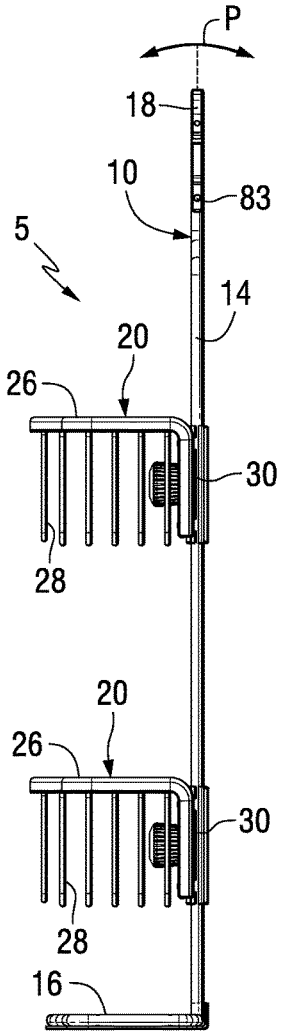
FIG. 3 is a side view of the shower caddy of FIG. 1.

The lower portion 82 may include a support structure connection hole 83. In accordance with an embodiment of the present invention, the vertical support structure 10 may be pivotably attached to the tilt-resisting support hook 18 by inserting a mechanical fastener through the support structure connection hole 83. This arrangement allows the shower caddy assembly 5 to hang vertically when mounted on shower pipes that may be oriented at different angles or when mounted at a location along the pipe that is offset from the back wall of a shower or bath enclosure against which the caddy rests. As shown in FIG. 3, the support hook 18 may be pivotable P around an axis of rotation corresponding to a longitudinal axis of the mechanical fastener in the support structure connection hole 83. Alternatively, the tilt-resisting support hook 18 and the vertical support structure 10 may be fixed in relation to each other or integrally formed. The tilt-resisting support hook 18 may be made of any suitable materials, including corrosion resistant metals such as aluminum and/or stainless steel, plastic or the like.

In accordance with an embodiment of the present invention, the generally U-shaped upper pipe engaging portion 81 may include a resilient liner 87 positioned along at least a portion of an interior surface of the upper pipe engaging portion. In accordance with an embodiment of the present invention, the resilient liner 87 may be made of natural rubber, synthetic rubber, soft polymer, or the like. The resilient liner 87 may be affixed to the interior surface of the generally U-shaped upper pipe engaging portion 81 by any suitable means such as an adhesive.

In accordance with an embodiment of the present invention, the generally U-shaped upper pipe engaging portion 81 comprises at least one threaded fastener hole 86 receiving a threaded fastener 88. As shown in FIG. 18, each downwardly extending side leg 84 may include a threaded fastener hole 86. In the embodiment shown, there are two threaded fastener holes 86 and associated fasteners 88, but any other suitable number of threaded fastener holes may be used. For example, there may be zero, one, three, four or more threaded fasteners. Each threaded fastener 88 extends from the exterior side surface to an interior side surface of the downwardly extending side leg 84 to press against the shower pipe. In the embodiment shown, a threaded fastener 88 is inserted into each threaded fastener hole 86 and tightened in order to secure the tilt-resisting support hook 18 and shower caddy assembly 5 in place.

The threaded fasteners 88 may be threaded and may comprise an Allen screw, thumb screw, flat head screw, Phillips head screw, or the like. The end 89 of each threaded fastener 88 may contact the resilient liner 87 to press against the shower pipe when tightened without direct contact between the threaded fasteners 88 and the shower pipe. The resilient liner 87 is forced against the shower pipe by the threaded fastener 88 to reduce or eliminate unwanted movement of the tilt-resisting support hook 18 and the shower caddy assembly 5. In the embodiment shown, the tilt-resisting support hook 18 comprising the resilient liner 87 and the threaded fastener holes 86 and associated fasteners 88 provide a tilt-resisting locking mechanism. In accordance with another embodiment of the present invention, the tilt-resisting support hook 18 may not include a resilient liner 87 and may instead include threaded fasteners 88 having resilient material positioned at their ends. For example, the threaded fasteners 88 may be an Allen type screw having a rubber tip on their ends that can be tightened directly against the shower pipe.

While a tilt-resisting support hook 18 is described herein, any other suitable tilt-resisting or non-tilt resisting support structure capable of supporting the caddy assembly 5 on a shower pipe may be used. Alternative tilt-resisting supports may include various types of clamps, clips and fasteners, such as disclosed in U.S. Patent Application Publication No. US2014/0224754 A1 published Aug. 14, 2014, which is incorporated herein by reference.

Whereas particular embodiments of this invention have been described above for purposes of illustration, it will be evident to those skilled in the art that numerous variations of the details of the present invention may be made without departing from the invention as defined in the appended claims.

What is claimed is:

1. A shower caddy assembly comprising:

a vertical support structure comprising a first and a second vertical support rod, wherein the first and second rods are generally parallel to each other and spaced apart to define an opening there between;

at least one basket comprising at least one horizontal basket support rod; and an adjustment mechanism comprising a generally planar front plate, a generally planar rear plate, and a draw fastener, wherein the draw fastener is threadingly engaged with the rear plate;

wherein the front plate and the rear plate each span across the opening; wherein the first and second support rods are each clamped between the first and second plates;

wherein the front plate comprises an upper distal edge, a lower distal edge opposite the upper distal edge, a planar upper front facing portion and a planar central front facing portion; wherein at least one horizontal guide channel is formed in the front plate;

wherein the upper front facing portion is above the at least one horizontal guide channel and the central front facing portion is below the at least one horizontal guide channel; wherein the upper front facing portion is in a plane parallel with a plane of the central front facing portion;

wherein the front and rear plates are slidably adjustable vertically along the first and second vertical support rods, and the at least one horizontal basket support rod is slidable horizontally within the at least one horizontal guide channel of the front plate while abutting the first and second vertical support rods.

2. The shower caddy assembly of claim 1, wherein the rear plate comprises first and second vertical guide channels slidably receiving the first and second vertical support rods.

3. The shower caddy assembly of claim 1, wherein the front and rear plates comprise first opposing vertical guide channels slidably receiving the first vertical support rod, and second opposing vertical guide channels slidably receiving the second vertical support rod.

4. The shower caddy assembly of claim 1, wherein the at least one horizontal basket support rod comprises an upper horizontal basket support rod and a lower horizontal basket support rod.

5. The shower caddy assembly of claim 4, wherein the at least one horizontal guide channel comprises a first horizontal guide channel slidably receiving the upper horizontal basket support rod, and a second horizontal guide channel slidably receiving the lower horizontal basket support rod.

6. The shower caddy assembly of claim 4, wherein the at least one horizontal guide channel comprises a first horizontal guide channel slidably receiving the upper horizontal basket support rod and a second horizontal guide channel slidably receiving the lower horizontal basket support rod, and the front and rear plates comprise first opposing vertical guide channels slidably receiving the first vertical support rod and second opposing vertical guide channels slidably receiving the second vertical support rod.

7. The shower caddy assembly of claim 6, wherein the first and second horizontal guide channels have a depth $D_H$ measured in a direction perpendicular to a planar surface of the front plate of from 0.1 to 0.8 inch.

8. The shower caddy assembly of claim 7, wherein the depth $D_H$ of the first and second horizontal guide channels is from 80 to 180 percent of a diameter of the upper and lower horizontal basket support rods.

9. The shower caddy assembly of claim 6, wherein the first and second vertical guide channels of the front plate have a depth $D_V$ measured in a direction perpendicular to a planar surface of the front plate of from 0.01 to 0.5 inch.

10. The shower caddy assembly of claim 9, wherein the first and second vertical guide channels of the back plate have a depth $D'_V$ measured in a direction perpendicular to a planar surface of the back plate of from 0.01 to 0.5 inch.

11. The shower caddy assembly of claim 10, wherein the depths $D_V$ of the first and second vertical guide channels of the front plate are equal to the depths $D'_V$ of the first and second vertical guide channels of the back plate.

12. The shower caddy assembly of claim 4, wherein each of the first and second vertical support rods contacts each of the first and second horizontal basket support rods when the draw fastener is tightened.

13. The shower caddy assembly of claim 12, wherein the draw fastener is centrally located between contact points at which the vertical support rods contact the horizontal basket support rods.

14. The shower caddy assembly of claim 1, wherein the draw fastener comprises a knob threadably engaged with the back plate.

15. The shower caddy assembly of claim 1, wherein the draw fastener comprises an internally threaded knob threadingly engaged with a threaded stud extending from the back plate.

16. The shower caddy assembly of claim 1, wherein the threaded stud extends through a hole in the front plate, and the knob contacts a front face of the front plate.

17. The shower caddy assembly of claim 1, comprising at least two of the baskets.

18. The shower caddy assembly of claim 1, further comprising a tilt-resisting support hook comprising an upper pipe engaging portion and a lower portion coupled to the vertical support structure.

19. The shower caddy assembly of claim 18, wherein the upper pipe engaging portion of the tilt-resisting support hook comprises a resilient liner positioned along at least a portion of an interior surface of the upper pipe engaging portion, and at least one threaded fastener hole structured and arranged to receive a threaded fastener.

20. The shower caddy assembly of claim 18, wherein the upper pipe engaging portion is generally U-shaped with downwardly extending side legs, each side leg comprises a threaded fastener hole receiving a threaded fastener, and each threaded fastener comprises an end contacting a resilient liner positioned along at least a portion of an interior surface of the upper pipe engaging portion.

* * * * *